US011504765B2

(12) United States Patent
Kunieda et al.

(10) Patent No.: US 11,504,765 B2
(45) **Date of Patent: *Nov. 22, 2022**

(54) TITANIUM CAST PRODUCT FOR HOT ROLLING UNLIKELY TO EXHIBIT SURFACE DEFECTS AND METHOD OF MANUFACTURING THE SAME

(71) Applicant: NIPPON STEEL & SUMITOMO METAL CORPORATION, Tokyo (JP)

(72) Inventors: Tomonori Kunieda, Tokyo (JP); Yoshitsugu Tatsuzawa, Tokyo (JP); Hideki Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 410 days.

This patent is subject to a terminal disclaimer.

(21) Appl. No.: 15/513,355

(22) PCT Filed: Sep. 30, 2014

(86) PCT No.: PCT/JP2014/076084
§ 371 (c)(1),
(2) Date: Mar. 22, 2017

(87) PCT Pub. No.: WO2016/051503
PCT Pub. Date: Apr. 7, 2016

(65) Prior Publication Data

US 2017/0304891 A1 Oct. 26, 2017

(51) Int. Cl.
*B22D 21/00* (2006.01)
*B21B 1/02* (2006.01)
(Continued)

(52) U.S. Cl.
CPC ..... *B22D 21/005* (2013.01); *B21B 1/02* (2013.01); *B21B 3/00* (2013.01); *C22C 14/00* (2013.01);
(Continued)

(58) Field of Classification Search
CPC ..... C22C 14/00; C22F 1/183; Y10S 428/926; B22D 21/005; B22D 21/06; B22D 29/00;
(Continued)

(56) References Cited

U.S. PATENT DOCUMENTS 3,765,954 A * 10/1973 Tokuda ..... C23C 12/00 148/220
4,902,359 A * 2/1990 Takeuchi ..... B23K 35/325 148/222
(Continued)

FOREIGN PATENT DOCUMENTS

CN 105102679 A 11/2015
EP 2 674 506 A1 12/2013
(Continued)

OTHER PUBLICATIONS

Encyclopedia Britannica "ingot" (Year: 2019).*
(Continued)

*Primary Examiner* — Paul A Wartalowicz
*Assistant Examiner* — Stephani Hill
(74) *Attorney, Agent, or Firm* — Birch, Stewart, Kolasch & Birch, LLP

(57) ABSTRACT

Provided is a titanium cast product for hot rolling made of commercially pure titanium, the titanium cast product including a melted and resolidified layer in a range of more than or equal to 1 mm in depth on a surface serving as a rolling surface, the melted and resolidified layer being obtained by adding one or more elements out of any one of or both of at least one α stabilizer element and at least one neutral element to the surface, and melting and resolidifying the surface. An average value of a total concentration of the at least one α stabilizer element and the at least one neutral element in the range of more than or equal to 1 mm in depth is higher than a total concentration of the at least one α
(Continued)

stabilizer element and the at least one neutral element in a base metal by, in mass %, more than or equal to 0.1% and less than 2.0%.

4 Claims, 1 Drawing Sheet

(51) Int. Cl.
*B21B 3/00* (2006.01)
*C22C 14/00* (2006.01)
*C22F 1/18* (2006.01)

(52) U.S. Cl.
CPC ..... *C22F 1/183* (2013.01); *B21B 2001/022* (2013.01); *B21B 2001/028* (2013.01)

(58) Field of Classification Search
CPC ..... B21B 1/02; B21B 3/00; B21B 2001/022; B21B 2001/028; C23C 26/00
See application file for complete search history.

(56) References Cited

U.S. PATENT DOCUMENTS

| | | | | | |
|---|---|---|---|---|---|
| 5,290,368 | A * | 3/1994 | Gavigan | ..... | B23K 35/325 148/212 |
| 5,792,289 | A * | 8/1998 | Morton | ..... | C22F 1/183 148/237 |
| 2014/0027024 | A1 | 1/2014 | Tatsuzawa et al. | | |
| 2016/0038983 | A1* | 2/2016 | Fujii | ..... | C22F 1/183 72/252.5 |
| 2017/0282231 | A1* | 10/2017 | Tatsuzawa | ..... | B21B 1/02 |

FOREIGN PATENT DOCUMENTS

| | | | | | |
|---|---|---|---|---|---|
| JP | 62-56561 | A | | 3/1987 | |
| JP | S6256561 | B2 | * | 11/1987 | ..... G11B 5/008 |
| JP | 1-156456 | A | | 6/1989 | |
| JP | 1-156457 | A | | 6/1989 | |
| JP | 7-102351 | A | | 4/1995 | |
| JP | 8-60317 | A | | 3/1996 | |
| JP | 09295008 | A | * | 11/1997 | |
| JP | 2004-115906 | A | | 4/2004 | |
| JP | 2007-84855 | A | | 4/2007 | |
| JP | 2007-332420 | A | | 12/2007 | |
| JP | 2007332420 | | * | 12/2007 | ..... B22D 29/00 |
| WO | WO 2012/108319 | A1 | | 8/2012 | |
| WO | WO-2012108319 | A1 | * | 8/2012 | ..... C22C 14/00 |
| WO | WO 2014/163086 | A1 | | 10/2014 | |
| WO | WO-2014163086 | A1 | * | 10/2014 | ..... B22D 21/005 |
| WO | WO-2014163087 | A1 | * | 10/2014 | ..... B22D 21/005 |
| WO | WO-2014163089 | A1 | * | 10/2014 | ..... B21B 1/22 |

OTHER PUBLICATIONS

JPH09-295008 machine translation (Year: 1997).*
Bralla. Chapter 2—Metal Forming Processes. Handbook of Manufacturing Processes: How Products, Components and Materials Are Made. Industrial Press, Inc. New York. 2007. pp. 33-51. (Year: 2007).*
Office Action dated Sep. 4, 2017, in Eurasian Patent Application No. 201790409/28, with partial English translation.
Chinese Office Action and Search Report, dated Aug. 1, 2018, in the Chinese Application No. 201480082158.6 with partial English translation.
Extended European Search Report dated Mar. 8, 2018, in European Patent Application No. 14903122.1.
Office Action dated Jan. 2, 2018, in Korean Patent Application No. 10-2017-7007577, with English translation.
Office Action dated Nov. 20, 2018, in Indian Patent Application No. 201717009074.
1st Office Action issued in JR 2014-549253 dated Oct. 27, 2015.
2nd Office Action issued in JR 2014-549253 dated May 31, 2016.
International Preliminary Report on patentability for PCT/JP2014/076084 (PCT/IPEA/409) dated Aug. 2, 2016.
International Search Report for PCT/JP2014/076084 dated Dec. 22, 2014.
Written Opinion of the International Searching Authority for PCT/JP2014/076084 (PCT/ISA/237) dated Dec. 22, 2014.
Office Action dated Mar. 27, 2019, in Chinese Patent Application No. 201480082158.6, with partial English translation.

* cited by examiner

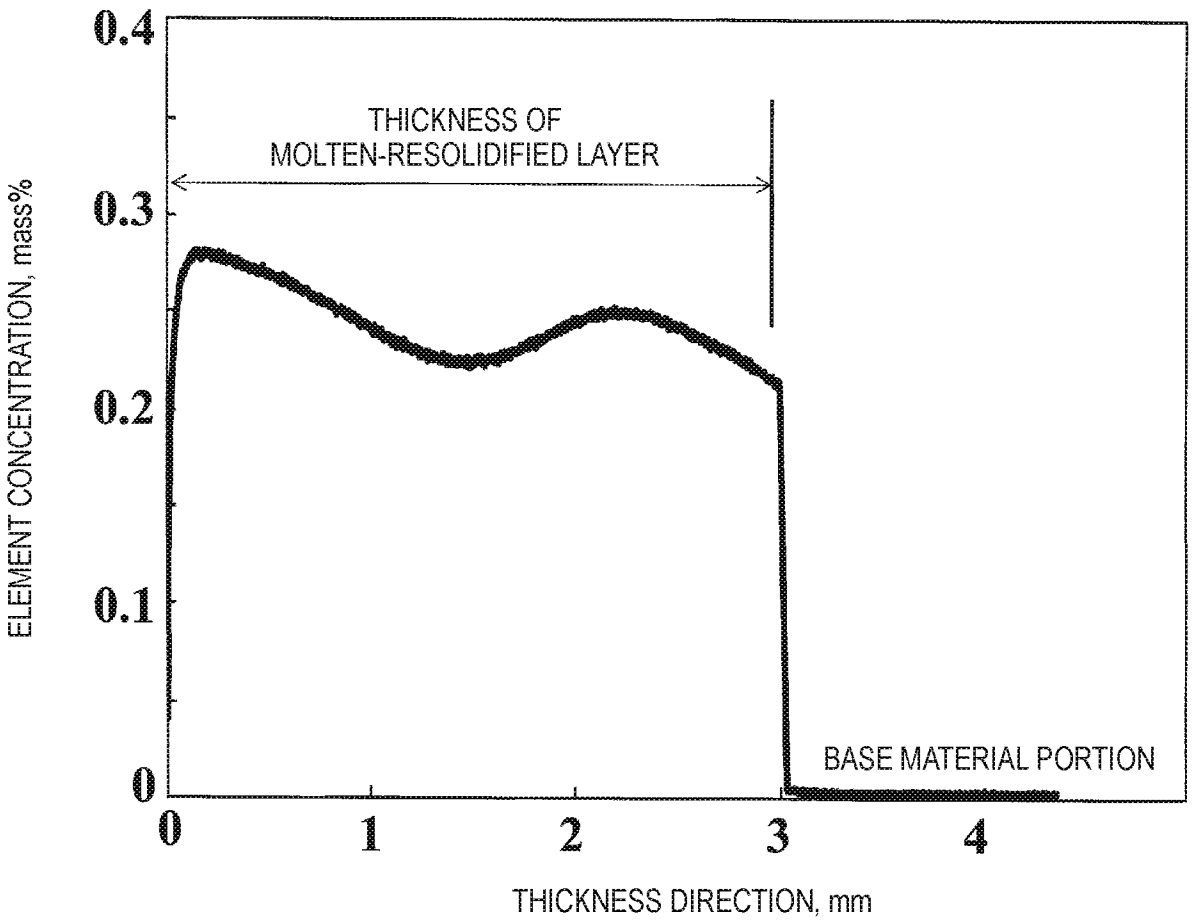
ELEMENT CONCENTRATION, mass%
0.4
0.3
0.2
0.1
0
THICKNESS OF
MOLTEN-RESOLIDIFIED LAYER
BASE MATERIAL PORTION
0
1
2
3
4
THICKNESS DIRECTION, mm

TITANIUM CAST PRODUCT FOR HOT ROLLING UNLIKELY TO EXHIBIT SURFACE DEFECTS AND METHOD OF MANUFACTURING THE SAME

TECHNICAL FIELD

The present invention relates to a titanium cast product for hot rolling and a method of manufacturing the same, and relates particularly to a titanium cast product for hot rolling that can keep surface properties after hot rolling satisfactory even when a slabing step and a finishing step are omitted, and a method of manufacturing the same.

BACKGROUND ART

A titanium material is generally manufactured by making an ingot obtained through a melting step into a shape of a slab or a billet, mending the surface, performing hot rolling, and then subjecting the resultant to annealing or cold working. The melting step includes, in addition to a vacuum arc remelting (VAR) method which is being used widely, an electron beam remelting (EBR) method or a plasma arc melting method involving performing melting at a place other than a mold and pouring the resultant into the mold. Since the shape of the mold is limited to a cylindrical shape in the former, a slabing step or a forging step is required for manufacturing a sheet material. The latter has high flexibility regarding the shape of the mold, hence can use a square-shaped mold in addition to the cylindrical mold. Accordingly, using the electron beam remelting method or the plasma arc melting method, the square-shaped ingot or the cylindrical ingot can be cast directly. Therefore, in the case of manufacturing a sheet material from a square-shaped ingot or in the case of manufacturing a wire material or a bar material from a cylindrical ingot, the slabing step can be omitted from the viewpoint of the shape of the ingot. In this case, since the cost and time spent for the slabing step can be reduced, remarkable improvements in production efficiency can be expected.

However, an as-cast structure of a large-sized ingot that is industrially used has coarse grains each having a grain size of several tens of millimeters. In the case where such an ingot is directly subjected to hot rolling without undergoing the slabing step, concavities and convexities are formed on the surface by the influence of deformation anisotropy in grains and between crystal grains due to coarse crystal grains and become surface defects. Accordingly, in the case where the square-shaped ingot or the cylindrical ingot is directly manufactured by the electron beam remelting method or the plasma arc melting method and the slabing step is omitted, surface defects occur in the hot rolling which is performed thereafter. In order to remove the surface defects occurred in the hot rolling, it is necessary that the amount of the surface of the hot-rolled sheet to be melted off in a pickling step be increased, and there arise problems that the cost is increased and the yield is reduced. That is, it is necessary that a finishing step for removing the surface defects be newly introduced. Therefore, there is a concern that the expected improvements in production efficiency owing to the omission of the slabing step may be cancelled due to the newly introduced finishing step. In regard to such a concern, there are proposed a method of manufacturing a material for hot rolling and a method of reducing the surface defects by performing fashioning or heat treatment after the manufacturing.

Patent Literature 1 proposes a method including, in the case where an ingot of a titanium material is not subjected to a slabing step and is directly subjected to a hot rolling process, in order to make crystal grains near an surface layer fine, providing a strain to the surface layer, and then performing heating to higher than or equal to recrystallization temperature and performing recrystallization on the surface to a depth of more than or equal to 2 mm. As means to provide a strain, there are given forging, roll reduction, shot blasting, and the like.

Patent Literature 2 proposes a method of reducing waviness or creases on the surface formed during rolling due to deformation anisotropy of coarse grains and reducing surface defects, by heating an ingot of a titanium material to higher than or equal to Tβ+50° C., then cooling the ingot to lower than or equal to Tβ-50° C., and then performing hot rolling.

Patent Literature 3 proposes, as a method of reducing surface defects of a rolled product in the case where the titanium material undergoes a slabing step, a method involving setting temperature at the end of a slabing step to an α region or performing heating before hot rolling in the temperature in the α phase, thereby rendering a portion more than or equal to 60 μm from the surface equiaxed crystals. In this way, Patent Literature 3 mentions that forming of a partly deep oxygen-rich layer can be avoided, the oxygen-rich layer can be removed in a descaling step, and hence, ununiform part in regard to hardness and ductility is eliminated, so the surface properties after cold working is improved.

Patent Literature 4 proposes a method in which, in the case where an ingot of a titanium material is not subjected to a hot working step and is directly subjected to hot rolling, an surface layer serving as a rolling surface of the ingot is melted and resolidified by high-frequency induction heating, arc heating, plasma heating, electron beam heating, laser heating, and the like, to thereby be turned into fine grains to a depth of more than or equal to 1 mm from the surface layer, and an surface layer structure after the hot rolling is improved. In the above, the surface layer portion is subjected to quench solidification to form a solidified structure having a fine structure with random orientations, and thus, the occurrence of the surface defects is prevented. Examples of methods for melting the surface layer structure of titanium slab include high-frequency induction heating, arc heating, plasma heating, electron beam heating, and laser heating.

CITATION LIST

Patent Literature

Patent Literature 1: JP H01-156456A
Patent Literature 2: JP H08-060317A
Patent Literature 3: JP H07-102351A
Patent Literature 4: JP 2007-332420A

SUMMARY OF INVENTION

Technical Problem

However, although the method of Patent Literature 1 gives the shot blasting as means to provide a strain, the depth of the strain provided by general shot blasting is approximately 300 to 500 μm, which is not sufficient for forming the recrystallized layer having a depth of more than or equal to 2 mm that is necessary for improving the quality. Accordingly, it is practically necessary that the strain be provided to a deeper position by the forging or the roll reduction, but a large plant is required for performing the forging or the roll reduction on a large-sized ingot for hot rolling, therefore, the cost is not reduced compared to the case of performing an ordinary slabing step.

Further, the method of Patent Literature 2 has an effect that coarse crystal grains recrystallize and are made fine by heating to a temperature in the β phase. However, in the case where the slabing step is omitted, there are few recrystallized nuclei since no work strain is applied and the sizes of the crystal grains become large since the whole ingot is heated so the cooling rate after the heating is reduced. Therefore, effects obtained by fine-making owing to recrystallization are limitative, and the reduction of the deformation anisotropy is not sufficient. It is also a factor of not being able to eliminate the deformation anisotropy that crystal orientations of the original coarse grains have influence over the recrystallized grains. On the contrary, moderate fine-making increases grain boundaries which cause concavities and convexities of the surface, and the occurrence of the surface defects is increased.

Still further, the method of Patent Literature 3 is performed from the assumption that the cast structure is broken to be turned into fine and equiaxed grains by undergoing the slabing step, and makes no sense in the case where the slabing step is omitted. If the slabing step is omitted and only heat treatment is performed to form equiaxed grains to a depth of more than or equal to 60 μm from the surface, it is a simple recrystallization, and the crystal orientation of the recrystallization is influenced by the original crystal orientation. Accordingly, the method is insufficient for preventing concavities and convexities due to deformation anisotropy of coarse grains of the as-cast structure, and it is apparent that problems caused by the surface defects occur.

Moreover, in the method of Patent Literature 4, modification is performed on the structure of the ingot surface layer portion, and this has an effect of improving the surface properties after hot rolling.

Accordingly, the present invention aims to provide an commercially pure titanium ingot that can keep surface properties after hot rolling satisfactory even when a slabing step and a finishing step are omitted, and a method of manufacturing the same.

Solution to Problem

In order to attain the above object, the inventors of the present invention have conducted intensive studies and have found the following. In manufacturing an commercially pure titanium product from an ingot by performing hot rolling and omitting a slabing step and a finishing step, an α stabilizer element or a neutral element is caused to be contained in a slab surface layer by placing or scattering a material (powder, chips, a wire, a thin film, and the like) containing the α stabilizer element or the neutral element on a rolling surface layer of an as-cast titanium material and remelting the slab surface layer together with the material as the previous step of hot rolling, hence, a structure of the slab surface layer portion can be kept fine even during hot rolling heating, and as a result, surface defects due to an influence of deformation anisotropy of an original coarse solidified structure are reduced, and the same surface properties as the case of undergoing the slabing step and the finishing step can be obtained.

The gist of the present invention is as follows.

(1)

A titanium cast product made of commercially pure titanium, the titanium cast product including:

a layer in a range of more than or equal to 1 mm in depth on a surface serving as a rolling surface, the layer containing one or more elements out of any one of or both of at least one α stabilizer element and at least one neutral element, wherein a total concentration of the at least one α stabilizer element and the at least one neutral element in the range of more than or equal to 1 mm in depth is higher than a total concentration of the at least one α stabilizer element and the at least one neutral element in a base metal by, in mass %, more than or equal to 0.1% and less than 2.0%.

(2)

The titanium cast product according to (1), wherein the at least one α stabilizer element and the at least one neutral element each include Al, Sn, and Zr.

(3)

The titanium cast product according to (1), wherein the layer containing one or more elements out of any one of or both of the at least one α stabilizer element and the at least one neutral element further contains, in mass %, less than or equal to 1.5% of one or more β stabilizer elements.

(4)

A method of manufacturing a titanium cast product, the method including:

melting a surface serving as a rolling surface of the titanium cast product together with a material containing one or more elements out of any one of or both of at least one α stabilizer element and at least one neutral element, and then solidifying the surface, wherein a total concentration of the at least one α stabilizer element and the at least one neutral element in the range of more than or equal to 1 mm in depth is made higher than a total concentration of the at least one α stabilizer element and the at least one neutral element in a base metal by, in mass %, more than or equal to 0.1% and less than 2.0%.

(5)

The method of manufacturing a titanium cast product according to (5), wherein the material containing one or more elements out of any one of or both of the at least one α stabilizer element and the at least one neutral element includes one or more of powder, chips, a wire, a thin film, and swarf.

(6)

The method of manufacturing a titanium cast product according to (5), wherein the surface of the titanium cast product is melted by using one or more of electron beam heating, arc heating, laser heating, plasma heating, and induction heating.

(7)

The method of manufacturing a titanium cast product according to (5), wherein the surface of the titanium cast product is melted in a vacuum atmosphere or an inert gas atmosphere.

Advantageous Effects of Invention

The titanium cast product for hot rolling and the method of manufacturing the same according to the present invention make it possible to manufacture a titanium material having surface properties that are higher than or equal to the case of undergoing a slabing step and a finishing step, even when, in manufacturing a titanium material, a hot working step such as slabing and forging and a finishing step to be performed thereafter, which have been necessary in the past, are omitted. Since improvements in the yield can be achieved by reduction in heating time owing to omission of a hot working step, reduction in cutting mending owing to slab surface smoothing, reduction in an amount of pickling owing to improvements in surface quality, and the like, great effects can be expected not only on reduction of manufacturing cost but also on improvements in energy efficiency, and industrial effects are immeasurable.

BRIEF DESCRIPTION OF DRAWINGS

FIG. 1 shows a schematic view of change in concentrations of a melted and resolidified layer.

DESCRIPTION OF EMBODIMENTS

Hereinafter, the present invention will be described in detail.

[Thickness of Melted and Resolidified Layer]

In the present invention, a titanium material made of commercially pure titanium has, on a surface serving as a rolling surface, a melted and resolidified layer having a depth of more than or equal to 1 mm. As described above, the occurrence of surface defects after hot rolling is caused by concavities and convexities of the surface of the titanium material, which occur due to a structure having coarse crystal grains. Accordingly, the crystal grain size only in an ingot surface layer portion may be made as small as possible. In order to suppress crystal grain growth during hot rolling heating by adding an α stabilizer element and/or a neutral element to be mentioned below and to thereby suppress the occurrence of surface defects, it is necessary that the thickness of the melted and resolidified layer containing the α stabilizer element and/or the neutral element be more than or equal to 1 mm. In the case where the thickness of the melted and resolidified layer is less than 1 mm, surface defects occur by being influenced by a cast structure of a lower structure, and the surface properties are not improved. Note that the maximum depth is not particularly defined, but if the melting depth is too large, there is a risk that a layer containing an alloying element may remain even after a shot pickling step which is performed after hot rolling, therefore, the melting depth is desirably up to approximately 5 mm. Note that, examples of the titanium materials to be subjected to hot rolling include an ingot, a slab, and a billet.

The melted and resolidified layer is formed by melting a surface of a titanium cast product, and then quenching and resolidifying the surface. Viewing a cross-section in a direction perpendicular to a scanning direction of a melted bead, the shape of the melted and resolidified layer tends to be the deepest at the center of the melted bead in remelting of the titanium cast product surface layer. When the melted beads are overlapped, a portion midway between adjacent melted beads is the shallowest, and the deepest part and the shallowest part are periodically repeated. In this case, if the difference between the deepest part and the shallowest part is large, this difference causes a difference in deformation resistances in hot rolling, which may cause defects. Accordingly, the difference is desirably less than 2 mm. Note that the depth of the melted and resolidified layer according to the present invention is set to more than or equal to 1 mm, and the depth indicates the depth of the shallowest part as viewed in a cross-section in a direction perpendicular to a scanning direction of a melted bead.

Here, the commercially pure titanium includes commercially pure titanium provided by class 1 to class 4 of the JIS standard, and their corresponding commercially pure titanium provided by Grades 1 to 4 of the ASTM standard and 3.7025 of the DIN standard. That is, it can be said that the commercially pure titanium dealt with in the present invention is an commercially pure titanium consisting of, in mass %, C: less than or equal to 0.1%, H: less than or equal to 0.015%, 0: less than or equal to 0.4%, N: less than or equal to 0.07%, Fe: less than or equal to 0.5%, and the balance: Ti.

[Content of α Stabilizer Element or Neutral Element]

In the present invention, the melted and resolidified layer contains one or more elements out of α stabilizer elements or neutral elements, the content of the one or more elements being higher than the content in the base metal portion by more than or equal to a certain content. Those elements can suppress crystal grain growth in a temperature in α phase when the elements are contained in titanium to some extent. Therefore, when the crystal grains are heated to an high temperature in the α phase range, which is a heating temperature range for hot rolling the commercially pure titanium, the crystal grains can generally be kept fine. In the present invention, as will be described later, in order to concentrate one or more elements out of a stabilizer elements or neutral elements, a technique is used that the ingot surface layer portion is melted together with a material made of one or more elements out of those elements. In this way, when the surface layer is melted with the material containing those elements, the elements in the surface layer portion in particular among the melted portion can be concentrated owing to influences such as solidification segregation. Therefore, by concentrating the elements in the surface layer by adding the elements in an amount more than the amount of the elements to be added, effects on making the structure finer can be exhibited more strongly. In addition, by concentrating the elements only in the surface layer portion of the melted and resolidified layer, diffusion of the alloying element contained in the surface layer portion into the interior during heat treatment such as hot rolling heating can be reduced, and deterioration of the quality of the material of the product can be suppressed. When the α stabilizer element(s) or neutral element(s) is/are added such that the average concentration of the α stabilizer element(s) or neutral element(s) in the melted and resolidified layer is higher by more than or equal to 0.1% in total than the concentration in the base metal portion, the element(s) is/are more concentrated near the surface layer portion and the crystal grain growth can be suppressed sufficiently, therefore, the lower limit is set to 0.1%. On the other hand, when the average concentration in the melted and resolidified layer is higher by more than or equal to 2.0% than the concentration in the base metal portion, there are risks that a difference of hot workability may occur between the surface layer portion containing the alloying element and the interior, that a crack may occur during hot rolling due to further concentrating of the element(s) in the surface layer portion, and that the quality of the material of the product may be deteriorated since the addition amount is large even when the elements are concentrated in the surface layer portion and a large amount of alloying element contained in the surface layer portion is diffused into the interior during heat treatment such as hot rolling heating, therefore, the upper limit is set to 2.0%. Two or more of the α stabilizer element(s) and/or the neutral element(s) may be added in combination, and the concentration of the α stabilizer element(s) and the neutral element(s) in that case is the total concentration of the concentrations of the respective elements.

[Types of α Stabilizer Element and Neutral Element]

In the present invention, as the α stabilizer element(s) and the neutral element(s), there may be used Al, Sn, and Zr. Those elements are each dissolved as a solid solution in the α phase, and suppress crystal grain growth in the heating temperature range during hot rolling.

[β Stabilizer Element]

In the present invention, a β stabilizer may be contained together with the α stabilizer element(s) and/or the neutral element(s). When the stabilizer is contained, not only the above-mentioned crystal grain growth, but also further structure-fine-making can be expected, since the β phase, which is the second phase in the heating temperature range during hot rolling, is easily generated, so that the crystal grain growth is further suppressed. In addition, by using titanium alloy scrap containing those alloying elements as an addition material, cost reduction can be expected.

[Method of Measuring Thickness of Melted and Resolidified Layer]

The present invention defines that the melted and resolidified layer in which alloying element(s) of the α stabilizer element(s) or the neutral element(s) is/are concentrated has a depth of more than or equal to 1 mm. The method of measuring the thickness of the melted and resolidified layer will be described. An embedded polishing sample of the cross-section of the concentrated layer can be easily determined by scanning electron microscopy (SEM)/electron probe microanalyser (EPMA). FIG. 1 shows a schematic view of change in concentrations of the melted and resolidified layer. Owing to the addition of the α stabilizer element(s) and/or the neutral element(s), the melted and resolidified layer has higher concentration of the α stabilizer element(s) and/or the neutral element(s) in comparison to the base metal portion, and the thickness of the portion in which the concentration of the α stabilizer element(s) and/or the neutral element(s) is higher is set to the thickness of the melted and resolidified layer. Note that, in the case where the melted and resolidified layer is larger than the measurement range of SEM/EPMA, the measurements are performed several times in the thickness direction, and the results are combined to measure the thickness of the melted and resolidified layer.

[Method of Measuring Element Concentrations in Melted Portion and Base Metal Portion]

The concentrations in the melted and resolidified layer and the base metal portion are determined by cutting out test pieces for analytical use from a part at which the concentration is increased and a central part of the material and performing ICP emission spectroscopic analysis on the test pieces. Regarding measurement of the concentrations, analysis samples may be collected from within 1 mm of the surface layer of any multiple sites (for example, 10 sites) of the rolling surface of a titanium cast product, ICP emission spectroscopic analysis may be performed on the analysis samples, and the average value thereof may be set as the concentration in the melted and resolidified layer. Further, by way of comparison, analysis samples may be collected from within 20 mm of the surface layer of any multiple sites (for example, 3 sites) of the rolling surface of the titanium cast product before remelting the surface layer of the titanium cast product, the ICP emission spectroscopic analysis may be performed in the same manner, and the average value thereof may be set as the concentration in the base metal portion.

[Addition Method]

In the present invention, in order to concentrate one or more elements out of a stabilizer elements or neutral elements in the surface layer portion of the ingot, a technique is used that the ingot surface layer portion is melted together with a material made of one or more elements out of those elements. In this way, the concentration of those elements in the surface layer portion of the ingot can be increased. Further, a titanium alloy containing those elements may be used. In this way, a β stabilizer element may also be contained easily together with those elements. As a material, powder, chips, a wire, a thin film, and swarf can be used individually or in combination.

[Method of Melting Surface Layer]

The present invention is characterized in that the titanium material surface layer portion is heated together with a material made of one or more elements out of a stabilizer elements or neutral elements, and is melted and resolidified. As the methods of heating the surface layer portion, there may be used electron beam heating, induction heating, arc heating, plasma heating, and laser heating may individually or in combination. In the case where the above methods are used in combination, for example, the surface layer may be preheated by induction heating, and then may be melted by laser heating. The method to be employed may be selected by taking into account conditions such as cost, the size of the titanium material, and treatment time. In the present invention, the titanium material surface layer portion is preferably heated in a vacuum or an inert gas atmosphere. Since titanium is an extremely active metal, a large amount of oxygen and nitrogen is mixed in the melted and resolidified portion if the treatment is performed in the atmosphere, resulting in change in the quality. Therefore, when the treatment is performed in a container under a vacuum or an inert atmosphere, a satisfactory result can be obtained. Note that inert gases according to the present invention represent argon and helium, and do not include nitrogen which reacts with titanium. The degree of vacuum in the case where the treatment is performed in a vacuum container, the degree of vacuum is desirably approximately higher than or equal to $5\times10^{-5}$ Torr.

The present invention provides a titanium material for hot rolling including a melted and resolidified layer in which one or more elements out of a stabilizer elements or neutral elements are concentrated in the above-mentioned range on an surface layer in a range of more than or equal to 1 mm in depth, and the other portion of the material is an as-cast structure or a structure obtained by performing casting, then performing heating to higher than or equal to the β transformation temperature, and thereafter performing quenching. Using this material, even when a slabing step is omitted, a titanium material having the same surface quality as the case of undergoing an ordinary slabing step can be obtained.

EXAMPLES

Hereinafter, the present invention will be described in detail by way of examples. Nos. 1 to 19 shown in Table 1 are each an example in which a sheet material is used, and Nos. 20 to 26 are each an example in which a wire material is used.

TABLE 1

| No. | Material | Product | Slabing | Ingot cutting mending | Molten-resolidified layer: Thickness | Molten-resolidified layer: Added element(s) | Molten-resolidified layer: Content (mass %) of α stabilizer element or neutral element | Molten-resolidified layer: Content (mass %) of β stabilizer element | Base metal: Content (mass %) of α stabilizer element or neutral element | Base metal: Content (mass %) of β stabilizer element | Difference between molten-resolidification layer and base material: α stabilizer element or neutral element (mass %) | Difference between molten-resolidification layer and base material: β stabilizer element (mass %) | Melting and resolidification treatment | Melting method | Element addition method | Surface defects | Evaluation | Notes |
|---|---|---|---|---|---|---|---|---|---|---|---|---|---|---|---|---|---|---|
| 1 | Class 1 pure titanium | Sheet Material | Yes | Yes | — | — | — | — | — | — | — | — | No | — | — | Minor | Good | Reference Example |
| 2 | Class 2 pure titanium | Sheet Material | No | Yes | 4.0 | — | 0.001 | — | 0.001 | — | 0 | — | Yes | TIG | — | Minor, but defects present in some parts, deteriorating | Fair | Comparative Example |
| 3 | Class 1 pure titanium | Sheet Material | No | Yes | 0.5 | Al | 0.20 | — | 0.001 | 0.05 | 0.199 | — | Yes | EB | Powder | Slightly coarse defects in some parts | Fair | Comparative Example |
| 4 | Class 1 pure titanium | Sheet Material | No | Yes | 2.6 | Al | 0.500 | — | 0.001 | — | 0.499 | — | Yes | EB | Chips | Minor | Good | Example |
| 5 | Class 1 pure titanium | Sheet Material | No | Yes | 1.6 | Al | 1.500 | — | 0.001 | — | 1.499 | — | Yes | Laser | Foil | Minor | Good | Example |
| 6 | Class 1 pure titanium | Sheet Material | No | Yes | 2.3 | Al | 0.800 | — | 0.002 | — | 0.798 | — | Yes | TIG | Foil | Minor | Good | Example |
| 7 | Class 2 pure titanium | Sheet Material | No | No | 2.1 | Al | 0.400 | — | 0.002 | — | 0.398 | — | Yes | EB | Powder | Minor | Good | Example |
| 8 | Class 1 pure titanium | Sheet Material | No | No | 2.2 | Sn | 1.000 | — | 0.002 | — | 0.998 | — | Yes | EB | Powder | Minor | Good | Example |
| 9 | Class 1 pure titanium | Sheet Material | No | No | 1.9 | Zr | 0.800 | — | 0.003 | — | 0.797 | — | Yes | EB | Swarf | Minor | Good | Example |
| 10 | Class 1 pure titanium | Sheet Material | No | No | 4.1 | Al + Zr | 1.100 | — | 0.003 | — | 1.097 | — | Yes | TIG | Swarf | Minor | Good | Example |
| 11 | Class 2 pure titanium | Sheet Material | No | No | 3.5 | Al + Sn | 0.300 | — | 0.001 | — | 0.299 | — | Yes | EB | Swarf | Minor | Good | Example |

TABLE 1-continued

| No. | Material | Product | Slabing | Ingot cutting mending | Molten-resolidified layer: Thickness | Molten-resolidified layer: Added element(s) | Molten-resolidified layer: Content (mass %) of α stabilizer element or neutral element | Molten-resolidified layer: Content (mass %) of β stabilizer element | Base metal: Content (mass %) of α stabilizer element or neutral element | Base metal: Content (mass %) of β stabilizer element | Difference between molten-resolidification layer and base material: α stabilizer element or neutral element (mass %) | Difference between molten-resolidification layer and base material: β stabilizer element (mass %) | Melting and resolidification treatment | Melting method | Element addition method | Surface defects | Evaluation | Notes |
|---|---|---|---|---|---|---|---|---|---|---|---|---|---|---|---|---|---|---|
| 12 | Class 1 pure titanium | Sheet Material | No | No | 1.9 | Al + V | 0.540 | 0.78 | 0.003 | 0.03 | 0.537 | 0.75 | Yes | EB | Swarf | Minor | Good | Example |
| 13 | Class 1 pure titanium | Sheet Material | No | No | 2.2 | Al + Fe | 0.440 | 0.10 | 0.002 | 0.05 | 0.438 | 0.05 | Yes | EB | Swarf | Minor | Good | Example |
| 14 | Class 1 pure titanium | Sheet Material | No | No | 2.8 | Al + Fe + V | 0.250 | 1.20 | 0.002 | 0.03 | 0.248 | 1.17 | Yes | TIG | Swarf | Minor | Good | Example |
| 15 | Class 1 pure titanium | Sheet Material | No | No | 1.7 | Al + Fe + Mo | 1.000 | 0.95 | 0.002 | 0.04 | 0.998 | 0.91 | Yes | EB | Swarf | Minor | Good | Example |
| 16 | Class 2 pure titanium | Sheet Material | No | No | 4.1 | Al | 0.300 | — | 0.002 | — | 0.298 | — | Yes | EB | Swarf | Minor | Good | Example |
| 17 | Class 2 pure titanium | Sheet Material | No | No | 1.9 | Sn | 1.300 | — | 0.001 | — | 1.299 | — | Yes | TIG | Swarf | Minor | Good | Example |
| 18 | Class 3 pure titanium | Sheet Material | No | No | 3.0 | Al | 0.400 | — | 0.003 | — | 0.397 | — | Yes | EB | Swarf | Minor | Good | Example |
| 19 | Class 4 pure titanium | Sheet Material | No | No | 3.6 | Al | 0.200 | — | 0.002 | — | 0.198 | — | Yes | EB | Swarf | Minor | Good | Example |
| 20 | Class 2 pure titanium | Wire Material | Yes | Yes | — | — | — | — | 0.003 | — | — | — | No | — | — | Minor | Good | Reference Example |
| 21 | Class 2 pure titanium | Wire Material | No | Yes | 2.5 | — | — | — | 0.003 | — | — | — | Yes | TIG | — | Minor, but defects present in some parts, deteriorating | Fair | Comparative Example |
| 22 | Class 2 pure titanium | Wire Material | No | Yes | 0.5 | Al | 0.15 | — | 0.002 | — | 0.148 | — | No | EB | Foil | Slightly coarse defects in some parts | Fair | Comparative Example |
| 23 | Class 2 pure titanium | Wire Material | No | Yes | 2.4 | Al | 0.15 | — | 0.003 | — | 0.147 | — | Yes | EB | Foil | Minor | Good | Example |

TABLE 1-continued

| | | | | | Molten-resolidified layer | | | | Base metal | | Difference between molten-resolidification layer and base material | | | | | | | |
|---|---|---|---|---|---|---|---|---|---|---|---|---|---|---|---|---|---|---|
| | | | | | | | Content | | Content | | | | | | | | | |
| No. | Material | Product | Slabing | Ingot cutting mending | Thickness | Added element(s) | (mass %) of α stabilizer element or neutral element | Content (mass %) of β stabilizer element | (mass %) of α stabilizer element or neutral element | Content (mass %) of β stabilizer element | α stabilizer element or neutral element (mass %) | β stabilizer element (mass %) | Melting and resolidification treatment | Melting method | Element addition method | Surface defects | Evaluation | Notes |
| 24 | Class 2 pure titanium | Wire Material | No | Yes | 6.5 | Al | 0.21 | — | 0.001 | — | 0.209 | — | Yes | TIG | Foil | Minor | Good | Example |
| 25 | Class 2 pure titanium | Wire Material | No | No | 2.7 | Sn | 0.91 | — | 0.001 | — | 0.909 | — | Yes | Laser | Powder | Minor | Good | Example |
| 26 | Class 2 pure titanium | Wire Material | No | No | 1.8 | Al | 0.70 | — | 0.003 | — | 0.697 | — | Yes | EB | Foil | Minor | Good | Example |

In each of Reference Example, Examples, and Comparative Examples shown in Nos. 1 to 19 of Table 1, a titanium cast product was manufactured by the electron beam remelting method, and was casted using a square-shaped mold. After that, in the case where cutting mending of a casting surface was performed, the cutting mending of an surface layer of the titanium cast product was performed, and in the case where the cutting mending is not performed, the melting of the surface layer was performed without performing the cutting mending of the surface layer. Next, an ingot having a thickness of 250 mm, a width of 1000 mm, and a length of 4500 mm was hot rolled using a hot rolling plant for a steel material, and was manufactured into a belt-shaped coil having a thickness of 4 mm. Note that an evaluation of surface defects was performed by visually observing a sheet surface layer after being subjected to pickling.

In each of Reference Example, Examples, and Comparative Examples of Nos. 1 to 6, after an ingot was manufactured, a casting surface of the ingot (cast product) was cut and removed. On the other hand, in each of Examples of Nos. 6 to 31, after an ingot was manufactured, a casting surface was subjected to melting and resolidification treatment.

In "melting method" shown in Table 1, "EB" represents performing melting and resolidification of the surface layer by an electron beam, "TIG" represents performing melting and resolidification of the surface layer by TIG welding, and "laser" represents performing melting and resolidification of the surface layer by laser welding. For the melting of the surface layer using the electron beam, an electron beam welding apparatus having a standard output of 30 kW was used. The melting of the surface layer performed by the TIG welding was performed at 200 A without using a filler material. For the melting of the surface layer performed by the laser welding, a $CO_2$ laser was used.

Reference Example of No. 1 describes a case where manufacturing was performed by using an commercially pure titanium ingot and following a conventional slabing step. Since the slabing step is performed, surface defects of the manufactured sheet material were minor.

In Comparative Example of No. 2, the ingot was subjected to cutting mending, and then was subjected to surface layer melting treatment using EB without adding an $\alpha$ stabilizer element or a neutral element. Therefore, the thickness of the melted and resolidified layer was as deep as more than or equal to 1 mm, and although the surface defects were minor, they occurred in some parts and were deteriorating.

In Comparative Example of No. 3, the ingot was subjected to the cutting mending, and then the surface of the ingot was subjected to the surface layer melting treatment using EB together with Al powder. Although the content of Al in the melted and resolidified portion was sufficiently high, which was higher by more than or equal to 0.1% compared to the base metal portion, the thickness was as small as 0.5 mm, and hence, slightly coarse surface defects were observed in some parts.

In Example of No. 4, the ingot was subjected to the cutting mending, after that, the surface of the ingot was subjected to the surface layer melting treatment using EB together with Al chips, the content of Al in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 5, the ingot was subjected to the cutting mending, after that, the surface of the ingot was subjected to the surface layer melting treatment using laser together with Al foil, the content of Al in the melted and resolidified layer was sufficiently high, which was higher by more than or equal to 0.1% compared to the base metal portion, and the thickness of the Al-concentrated layer was as deep as more than or equal to 1 mm, and hence, the surface defects were minor, which was the same level as the case of undergoing the slabing step.

In Example of No. 6, the ingot was subjected to the cutting mending, after that, the surface of the ingot was subjected to the surface layer melting treatment using TIG together with Al foil, the content of Al in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 7, the ingot was not subjected to cutting, the surface of the ingot was subjected to the surface layer melting treatment using EB together with Al powder, the content of Al in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 8, the ingot was not subjected to cutting, the surface of the ingot was subjected to the surface layer melting treatment using EB together with Sn powder, the content of Sn in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 9, the ingot was not subjected to cutting, the surface of the ingot was subjected to the surface layer melting treatment using EB together with Zr swarf, the content of Zr in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 10, the ingot was not subjected to cutting, the surface of the ingot was subjected to the surface layer melting treatment using TIG together with powder of Al and Zr, the total content of Al and Zr in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 11, the ingot was not subjected to cutting, the surface of the ingot was subjected to the surface layer melting treatment using TIG together with swarf of a titanium alloy containing Al and Sn, the total content of Al and Sn in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In each of Examples of No. 12 to 15, the ingot was not subjected to cutting, the surface of the ingot was subjected to the surface layer melting treatment using TIG together with swarf of a titanium alloy containing Al and a β stabilizer element, the content of Al in the melted and resolidified layer was sufficiently high, which was higher by more than or equal to 0.1% compared to the base metal portion, and the content of the β stabilizer element was as low as less than or equal to 1.5%. Further, the thickness was as deep as more than or equal to 1 mm, and hence, the surface defects were minor, which was the same level as the case of undergoing the slabing step.

In Example of No. 16, the ingot was not subjected to cutting, the surface of the ingot was subjected to the surface layer melting treatment using EB together with Al chip, the content of Al in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 17, the ingot was not subjected to cutting, the surface of the ingot was subjected to the surface layer melting treatment using TIG together with Sn powder, the content of Sn in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Examples of Nos. 18 and 19, the ingots made of class 3 pure titanium and class 4 pure titanium, respectively, were not subjected to cutting, the surface of each ingot was subjected to the surface layer melting treatment using EB together with Al powder, the content of Al in each melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In each of Reference Example, Comparative Examples, and Examples shown in Nos. 20 to 26 of Table 1, the class 2 commercially pure titanium was used, and a titanium ingot was manufactured by the vacuum arc remelting method or the electron beam remelting method. An ingot having a diameter of 170 mm and a length of 12 m was hot rolled, and was manufactured into a wire material having a diameter of 13 mm. Note that an evaluation of surface defects was performed by visually observing a sheet surface layer after being subjected to pickling.

In each of Reference Example, Comparative Examples, and Examples of Nos. 20 to 24, after an ingot was manufactured, a casting surface of the ingot was cut and removed. On the other hand, in each of Examples of Nos. 25 and 26, after an ingot was manufactured, a casting surface was subjected to melting and resolidification treatment.

Reference Example of No. 20 describes a case where manufacturing was performed by following a conventional slabing step.

In Comparative Example of No. 21, the ingot was subjected to cutting mending, and then was subjected to surface layer melting treatment using EB without adding an α stabilizer element or a neutral element. Therefore, the thickness of the melted and resolidified portion was as deep as more than or equal to 1 mm, and although the surface defects tend to be minor, they occurred in some parts and were deteriorating.

In Comparative Example of No. 22, the ingot was subjected to the cutting mending, and then the surface of the ingot was subjected to the surface layer melting treatment using EB together with Al foil. Although the content of Al in the melted and resolidified portion was sufficiently high, which was higher by more than or equal to 0.1% compared to the base metal portion, the thickness was as small as 0.5 mm, and hence, slightly coarse surface defects were observed in some parts.

In Example of No. 23, the ingot was subjected to the cutting mending, after that, the surface of the ingot was subjected to the surface layer melting treatment using EB together with Al foil, the content of Al in the melted and resolidified layer was sufficiently high, which was higher by more than or equal to 0.1% compared to the base metal portion, and the thickness was as deep as more than or equal to 1 mm, and hence, the surface defects were minor, which was the same level as the case of undergoing the slabing step.

In Example of No. 24, the ingot was subjected to the cutting mending, after that, the surface of the ingot was subjected to the surface layer melting treatment using TIG together with Al foil, the content of Al in the melted and resolidified layer was sufficiently high, which was higher by more than or equal to 0.1%, and the thickness was as deep as more than or equal to 1 mm, and hence, the surface defects were minor, which was the same level as the case of undergoing the slabing step.

In Example of No. 25, the ingot was subjected to the cutting mending, after that, the surface of the ingot was subjected to the surface layer melting treatment using laser together with Sn powder, the content of Sn in the melted and resolidified layer was sufficiently high, which was higher by more than or equal to 0.1% compared to the base metal portion, and the thickness of the Sn-concentrated layer was as deep as more than or equal to 1 mm, and hence, the surface defects were minor, which was the same level as the case of undergoing the slabing step.

In Example of No. 26, the ingot was subjected to the cutting mending, after that, the surface of the ingot was subjected to the surface layer melting treatment using EB together with Al foil, the content of Al in the melted and resolidified layer was sufficiently high, which was higher by more than or equal to 0.1% compared to the base metal portion, and the thickness of the Al-concentrated layer was as deep as more than or equal to 1 mm, and hence, the surface defects were minor, which was the same level as the case of undergoing the slabing step.

The invention claimed is:

1. A method of manufacturing a titanium cast product, the method comprising:

melting a surface of a base metal of a titanium ingot consisting of 0.1 mass % or less C, 0.015 mass % or less H, 0.4 mass % or less O, 0.07 mass % or less N, 0.5 mass % or less Fe, and a balance of Ti and impurities together with a material, in contact with the surface, containing one or more elements out of any one of or both of at least one α stabilizer element and at least one neutral element, then solidifying the surface with the material to make a layer in a range of 1 mm or more on the surface to form a titanium cast product, and performing hot rolling on the titanium cast product, wherein a total concentration of a total of at least one a stabilizer element and at least one neutral element within 1 mm in depth of the surface of the titanium cast product is made higher than a total concentration of a total of at least one α stabilizer element and at least one neutral element in the base metal by, in mass %, 0.1% to 1.499%, wherein the layer within 1 mm in depth of the surface further contains, in mass %, 0% to 1.5% of one or more β stabilizer elements, wherein the at least one α stabilizer element includes Al and wherein the at least one neutral element includes one of Sn and Zr.

2. The method of manufacturing a titanium cast product according to claim 1, wherein the material containing one or more elements out of any one of or both of at least one a stabilizer element and at least one neutral element includes one or more of powder, chips, a wire, a thin film, and swarf.

3. The method of manufacturing a titanium cast product according to claim 1, wherein the surface of the base metal of the titanium ingot is melted by using one or more of electron beam heating, arc heating, laser heating, plasma heating, and induction heating.

4. The method of manufacturing a titanium cast product according to claim 1, wherein the surface of the base metal of the titanium ingot is melted in a vacuum atmosphere or an inert gas atmosphere.

* * * * *